US011709519B2

(12) United States Patent
Shiina

(10) Patent No.: US 11,709,519 B2
(45) Date of Patent: Jul. 25, 2023

(54) REFERENCE VOLTAGE CIRCUIT

(71) Applicant: ABLIC Inc., Tokyo (JP)

(72) Inventor: Yoshiomi Shiina, Tokyo (JP)

(73) Assignee: ABLIC INC., Tokyo (JP)

( * ) Notice: Subject to any disclaimer, the term of this patent is extended or adjusted under 35 U.S.C. 154(b) by 0 days.

(21) Appl. No.: 17/406,460

(22) Filed: Aug. 19, 2021

(65) Prior Publication Data

US 2022/0057825 A1 Feb. 24, 2022

(30) Foreign Application Priority Data

Aug. 21, 2020 (JP) ..... 2020-139899

(51) Int. Cl.
*G05F 3/26* (2006.01)

(52) U.S. Cl.
CPC ..... *G05F 3/265* (2013.01)

(58) Field of Classification Search
CPC . G05F 3/265; G05F 3/267; G05F 3/30; G05F 3/24; G05F 3/247; G05F 3/20
See application file for complete search history.

(56) References Cited

U.S. PATENT DOCUMENTS 9,921,594 B1 * 3/2018 Kovac ..... G05F 1/462
2005/0040803 A1 2/2005 Ueda
2008/0309308 A1 * 12/2008 Howe ..... G05F 3/30 323/313
2020/0326737 A1 * 10/2020 Inoue ..... H03K 17/0822
2020/0333821 A1 10/2020 Tomonaga et al.

FOREIGN PATENT DOCUMENTS

JP 2003-258105 A 9/2003
JP 2019-133569 A 8/2019

* cited by examiner

*Primary Examiner* — Nguyen Tran
(74) *Attorney, Agent, or Firm* — Crowell & Moring LLP

(57) ABSTRACT

Provided is a reference voltage circuit configured to supply a reference voltage in which a variation in voltage with respect to a variation in power supply voltage is suppressed. The reference voltage circuit includes a reference voltage generation circuit which includes an output line for supplying a generated reference voltage to an output terminal; and an output control circuit which includes an output transistor and a stabilization transistor, and is configured to control the supply of the reference voltage to the output terminal, the output transistor containing a gate to which a control voltage is to be provided, the stabilization transistor containing a gate to be connected to a source of the output transistor, and a source to be connected to a drain of the output transistor, and having a gate-source voltage that is equal to or more than a dram-source voltage in a saturation region of the output transistor.

6 Claims, 3 Drawing Sheets

REFERENCE VOLTAGE CIRCUIT

RELATED APPLICATIONS

This application claims priority to Japanese Patent Application No. 2020-139899, filed on Aug. 21, 2020, the entire content of which is incorporated herein by reference.

BACKGROUND OF THE INVENTION

1. Field of the Invention

The present invention relates to a reference voltage circuit.

2. Description of the Related Art

As an example of a reference voltage circuit configured to generate, as a reference voltage, a constant voltage that does not depend on a variation in power supply voltage or a variation in temperature, a bandgap reference (BGR) circuit is used. For example, there is known a reference voltage circuit including a BGR circuit in which an output transistor, for example, an NMOS transistor is connected between an output terminal from which a reference voltage is provided and a power supply terminal (see, for example, Japanese Patent Application Laid-open No. 2019-133569).

However, in the conventional reference voltage circuit, as a drain of the output transistor is directly connected to the power supply terminal, an operating point of the output transistor is susceptible to a variation in power supply voltage. Consequently, with the conventional reference voltage circuit described above, in a case in which the power supply voltage has varied, the operating point of the output transistor has varied, and it has been difficult to supply a reference voltage which is constant in voltage.

SUMMARY OF THE INVENTION

The present invention has been made in view of the above-described circumstances, and an object thereof is to provide a reference voltage circuit configured to supply a reference voltage in which a variation in voltage with respect to a variation in power supply voltage is suppressed.

According to an aspect of the present invention, there is provided a reference voltage circuit including an output terminal, the reference voltage circuit including: a reference voltage generation circuit which is configured to generate a reference voltage, and includes an output line for supplying the generated reference voltage to the output terminal; and an output control circuit which includes an output transistor and a stabilization transistor, and is configured to control the supply of the reference voltage to the output terminal, the output transistor containing a gate to which a control voltage is to be provided, a dram, and a source, the stabilization transistor containing a gate to be connected to the source of the output transistor, a dram, and a source to be connected to the dram of the output transistor, the stabilization transistor being configured to have a gate-source voltage that is equal to or more than a dram-source voltage in a saturation region of the output transistor.

According to the present invention, the reference voltage in which the variation in voltage with respect to the variation in power supply voltage is suppressed can be provided.

DETAILED DESCRIPTION OF THE PREFERRED EMBODIMENTS

Figure 1:
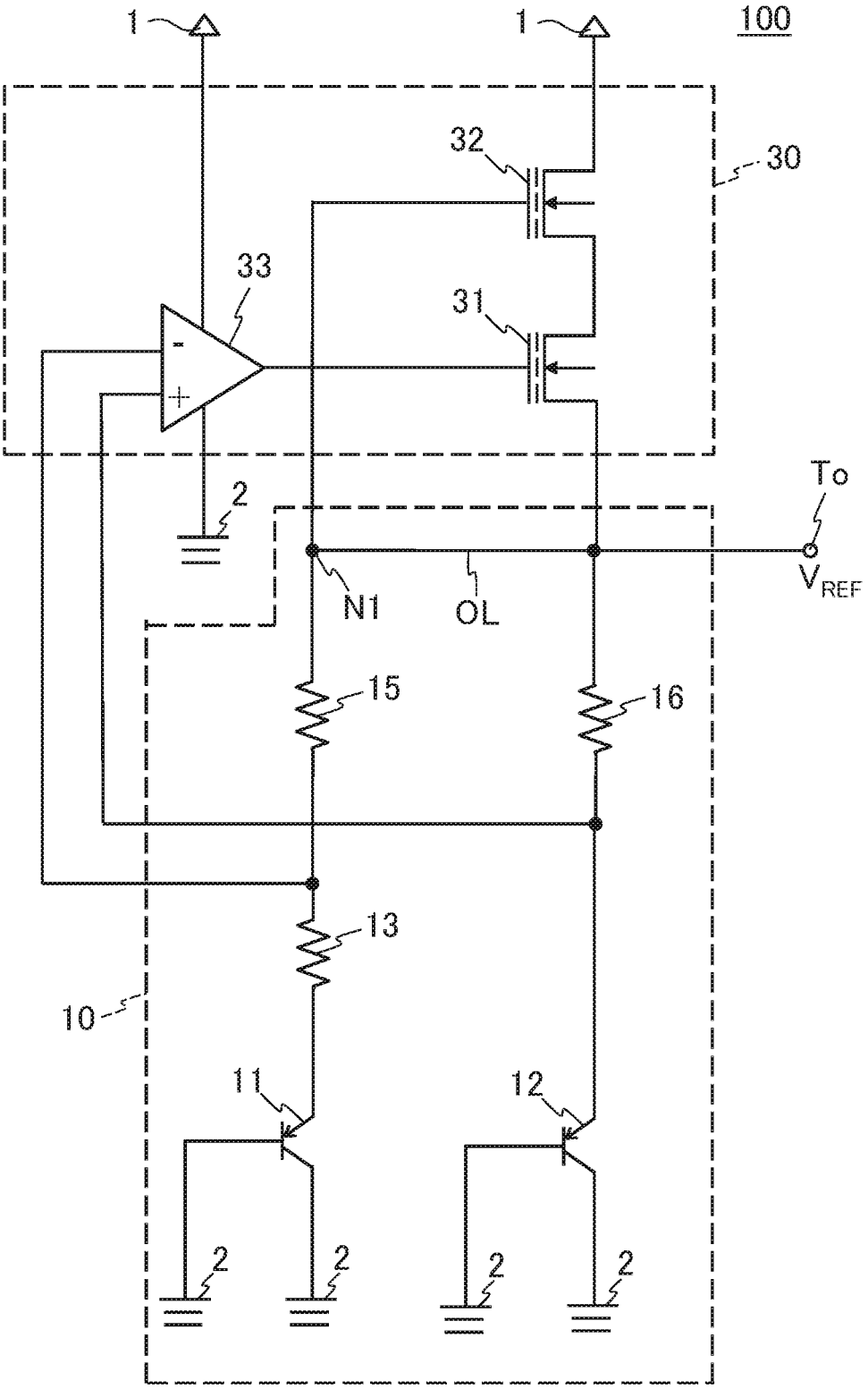
FIG. 1 is a circuit diagram for illustrating a first configuration example of a reference voltage circuit according to an embodiment of the present invention.

Now, a reference voltage circuit according to an embodiment of the present invention is described with reference to the drawings. For the purpose of describing the embodiment, of both ends of each of resistors and a constant current source illustrated in the drawings, an end located on the upper side is referred to as a "first end," and an end located on the lower side is referred to as a "second end."

FIG. 1 is a circuit diagram for illustrating a reference voltage circuit 100 serving as a first configuration example of a reference voltage circuit according to an embodiment of the present invention.

The reference voltage circuit 100 includes a reference voltage generation circuit 10 serving as a bandgap reference (BGR) circuit, and an output control circuit 30. Further, the reference voltage generation circuit 10, the output control circuit 30, and an output terminal To are connected to one another at a node N1. Here, the node N1 is a connection point among a source of a depletion NMOS transistor 31, a gate of a depletion NMOS transistor 32, a first end of a resistor 15, a first end of a resistor 16, and the output terminal To.

The reference voltage generation circuit 10 includes PNP bipolar transistors 11 and 12, and resistors 13, 13, and 16.

The PNP bipolar transistor 11 serving as a first diode contains a base and a collector connected (grounded) to a ground terminal 2 serving as a second power supply terminal for supplying a second power supply voltage. Consequently, the base and the collector serving as a cathode of the first diode are connected (short-circuited) via the ground terminal 2. An emitter of the PNP bipolar transistor 11, the emitter serving as an anode of the first diode is connected to a second end of the resistor 13.

The PNP bipolar transistor 12 serving as a second diode is configured to have the same size as the PNP bipolar transistor 11. The PNP bipolar transistor 12 contains a base and a collector connected (grounded) to the ground terminal 2. Consequently, the base and the collector serving as a cathode of the second diode are connected (short-circuited) via the ground terminal 2. An emitter of the PNP bipolar transistor 12 serving as an anode of the second diode is connected to a second end of the resistor 16.

A ratio (emitter area ratio) of an emitter area of the PNP bipolar transistor 11 to an emitter area of the PNP bipolar transistor 12 is set to N:1, herein N is larger than 0. That is, the PNP bipolar transistor 11 contains an emitter of which an area is N(>0) times larger than the emitter area of the PNP bipolar transistor 12.

The resistor 15 serving as a second resistor contains the first end to be connected to the node N1, and a second end to be connected to a first end of the resistor 13 serving as a first resistor and an inverting input port (−) of an operational amplifier 33.

The resistor 16 serving as a third resistor contains the first end to be connected to the node NL and a second end to be connected to the emitter of the PNP bipolar transistor 12 and anon-inverting input port (+) of the operational amplifier 33.

The reference voltage generation circuit 10 includes an output line OL to which the first end of the resistor 15, the first end of the resistor 16, and the output terminal To are connected, and a reference voltage $V_{REF}$ IS supplied from the output line OL to the output terminal To.

The output control circuit 30 includes the depletion NMOS transistors 31 and 32, and the operational amplifier 33, and is configured to control the supply of the reference voltage $V_{REF}$ to the output terminal To.

The depletion NMOS transistor 31 serving as an output transistor and a first depletion NMOS transistor contains a gate to be connected to an output port of the operational amplifier 33, a drain, and the source to be connected to the output line OL.

The depletion NMOS transistor 32 serving as a stabilization transistor and a second depletion NMOS transistor contains the gate to be connected to the source of the depletion NMOS transistor 31 via the output line OL, a drain to be connected to a power supply terminal 1, and a source to be connected to the dram of the depletion NMOS transistor 31.

The depletion NMOS transistor 32 is set so as to have such a constant that a gate-source voltage VGS_32 is equal to or more than a drain-source voltage VDS__31*s* in a saturation region of the depletion NMOS transistor 31. In other words, the depletion NMOS transistor 32 is configured to satisfy the following expression (1):

$$VGS_32 \geq VDS_31s \quad (1).$$

The operational amplifier 33 contains a positive power supply port, a negative power supply port, the non-inverting input port (+), the inverting input port (−), and the output port, and is configured to supply a control voltage from the output port.

The positive power supply port is connected to the power supply terminal 1 serving as a first power supply terminal for supplying a first power supply voltage. The negative power supply port is connected to the ground terminal 2. The non-inverting input port (+) is connected to a node between the emitter of the PNP bipolar transistor 12 and the second end of the resistor 16. Further, the inverting input port (−) is connected to a node between the first end of the resistor 13 and the second end of the resistor 15. The output port is connected to the gate of the depletion NMOS transistor 31, and the control voltage is provided to the gate of the depletion NMOS transistor 31.

Next, an action and an effect of the reference voltage circuit 100 are described.

In the reference voltage circuit 100, the reference voltage generation circuit 10 generates the reference voltage $V_{REF}$. The reference voltage $V_{REF}$ is supplied to the output terminal To through the output line OL. Further, the output control circuit 30 controls the supply of the reference voltage $V_{REF}$ to the output terminal To.

In the output control circuit 30, a drain-source voltage VDS_31 of the depletion NMOS transistor 31 is applied with a constant bias by the gate-source voltage VGS_32 of the depletion NMOS transistor 32.

The source of the depletion NMOS transistor 32 has a potential of $V_{REF}$+VGS_32 which is higher than the reference voltage $V_{REF}$ by the gate-source voltage VGS_32 of the depletion NMOS transistor 32. The source of the depletion NMOS transistor 31 has a potential that is equal to a potential of the gate of the depletion NMOS transistor 32.

Consequently, if the first power supply voltage varies, while a dram-source voltage of the depletion NMOS transistor 32 varies, the drain-source voltage of the depletion NMOS transistor 31 does not vary and is kept constant. Further, during a period in which the reference voltage $V_{REF}$ increases from 0 volts to a predetermined voltage at startup, the dram-source voltage of the depletion NMOS transistor 31 does not vary and is kept constant.

According to the reference voltage circuit 100 configured as described above, as the dram-source voltage of the depletion NMOS transistor 31 does not vary even if the first power supply voltage varies, an operating point of the depletion NMOS transistor 31 does not vary. Consequently, a stable reference voltage $V_{REF}$ can be supplied from the output terminal To the outside.

With the reference voltage circuit 100, as the drain-source voltage of the depletion NMOS transistor 31 does not vary during the period in which the reference voltage $V_{REF}$ reaches the predetermined voltage from 0 volts at startup, a stable startup characteristic can be obtained.

The reference voltage circuit according to the embodiment is not limited to the reference voltage circuit 100, and may be, for example, a reference voltage circuit 200 (FIG. 2) or 300 (FIG. 3) to be described later.

Figure 2:
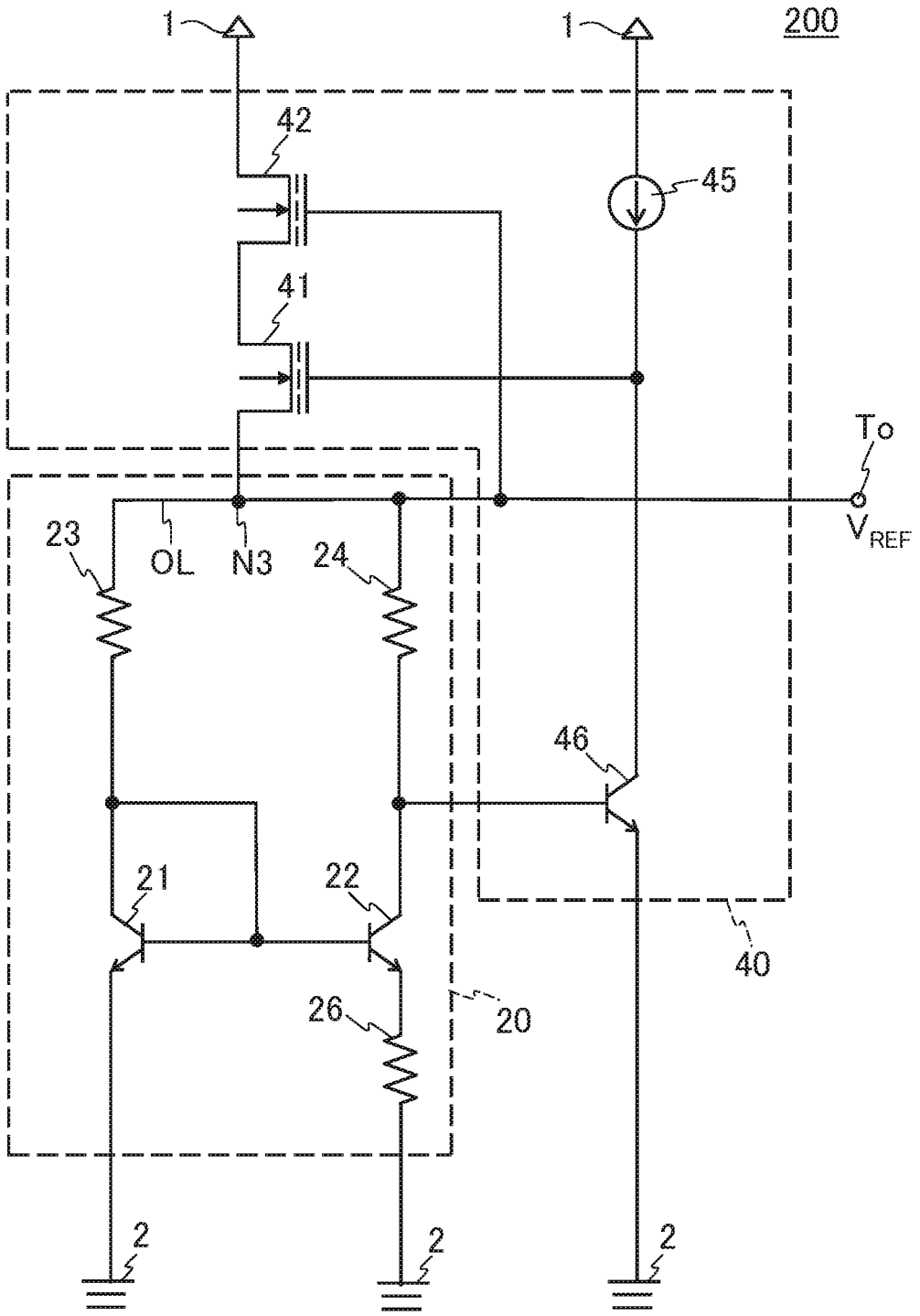
FIG. 2 is a circuit diagram for illustrating a second configuration example of the reference voltage circuit according to the embodiment.

FIG. 2 is a circuit diagram for illustrating a reference voltage circuit 200 serving as a second configuration example of the reference voltage circuit according to the embodiment.

The reference voltage circuit 200 includes a reference voltage generation circuit 20 serving as a so-called Widlar BGR circuit, and an output control circuit 40. Further, the reference voltage generation circuit 20, the output control circuit 40, and an output terminal To are connected to one another at a node N3. Here, the node N3 is a connection point among a source of a depletion NMOS transistor 41, a gate of a depletion NMOS transistor 42, a first end of a resistor 23, a first end of a resistor 24, and the output terminal To.

The reference voltage generation circuit 20 includes NPN bipolar transistors 21 and 22, and resistors 23, 24, and 26.

While the NPN bipolar transistor 21 serving as a diode is directly connected to the ground terminal 2, the NPN bipolar transistor 22 serving as a first bipolar transistor is connected to the ground terminal 2 via the resistor 26. Further, the NPN bipolar transistor 21 is diode-connected, and forms a current mirror circuit together with the NPN bipolar transistor 22.

Between a collector of the NPN bipolar transistor 21 and the node N3, the resistor 23 is connected. Between a collector of the NPN bipolar transistor 22 and the node N3, the resistor 24 is connected.

The resistor 23 serving as a first resistor contains a first end to be connected to the output line OL, and a second end to be connected to the collector of the NPN bipolar transistor 21 serving as an anode of the diode.

The resistor 24 serving as a second resistor contains a first end to be connected to the output line OL, and a second end to be connected to the collector of the NPN bipolar transistor 22.

The resistor 26 serving as a third resistor contains a first end to be connected to an emitter of the NPN bipolar transistor 22, and a second end to be connected to the ground terminal 2.

The output control circuit 40 includes the depletion NMOS transistors 41 and 42, a constant current source 45, and an NPN bipolar transistor 46.

The depletion NMOS transistor 41 serving as an output transistor and a first depletion NMOS transistor contains a gate to be connected to a second end of the constant current source 45 and a collector of the NPN bipolar transistor 46, and a source to be connected to the node N3.

The depletion NMOS transistor 42 serving as a stabilization transistor and a second depletion NMOS transistor contains a gate to be connected to the node N3, a dram to be connected to a power supply terminal 1, and a source to be connected to a drain of the depletion NMOS transistor 41.

Similarly, to the depletion NMOS transistor 32, the depletion NMOS transistor 42 is set so as to have such a constant that a gate-source voltage VGS_42 is equal to or more than a drain-source voltage VDS_41*s* in a saturation region of the depletion NMOS transistor 41. In other words, the depletion NMOS transistor 42 is configured to satisfy the following expression (2):

$$VGS_42 \geq VDS_41s \quad (2).$$

The constant current source 45 contains a first end to be connected to the power supply terminal 1, and the second end to be connected to the gate of the depletion NMOS transistor 41 and the collector of the NPN bipolar transistor 46.

The NPN bipolar transistor 46 serving as a second bipolar transistor contains a base to be connected to the collector of the NPN bipolar transistor 22 and the second end of the resistor 24, the collector to be connected to the second end of the constant current source 45 and the gate of the depletion NMOS transistor 41, and an emitter to be connected to the ground terminal 2.

The reference voltage circuit 200 configured as described above acts similarly to the reference voltage circuit 100, and can provide a similar effect to that of the reference voltage circuit 100. That is, details of the action and the effect of the reference voltage circuit 200 can be described by reading, in the description of the action and the effect of the reference voltage circuit 100 described above, the output control circuit 30 and the depletion NMOS transistors 31 and 32 as the output control circuit 40 and the depletion NMOS transistors 41 and 42, respectively.

Figure 3:
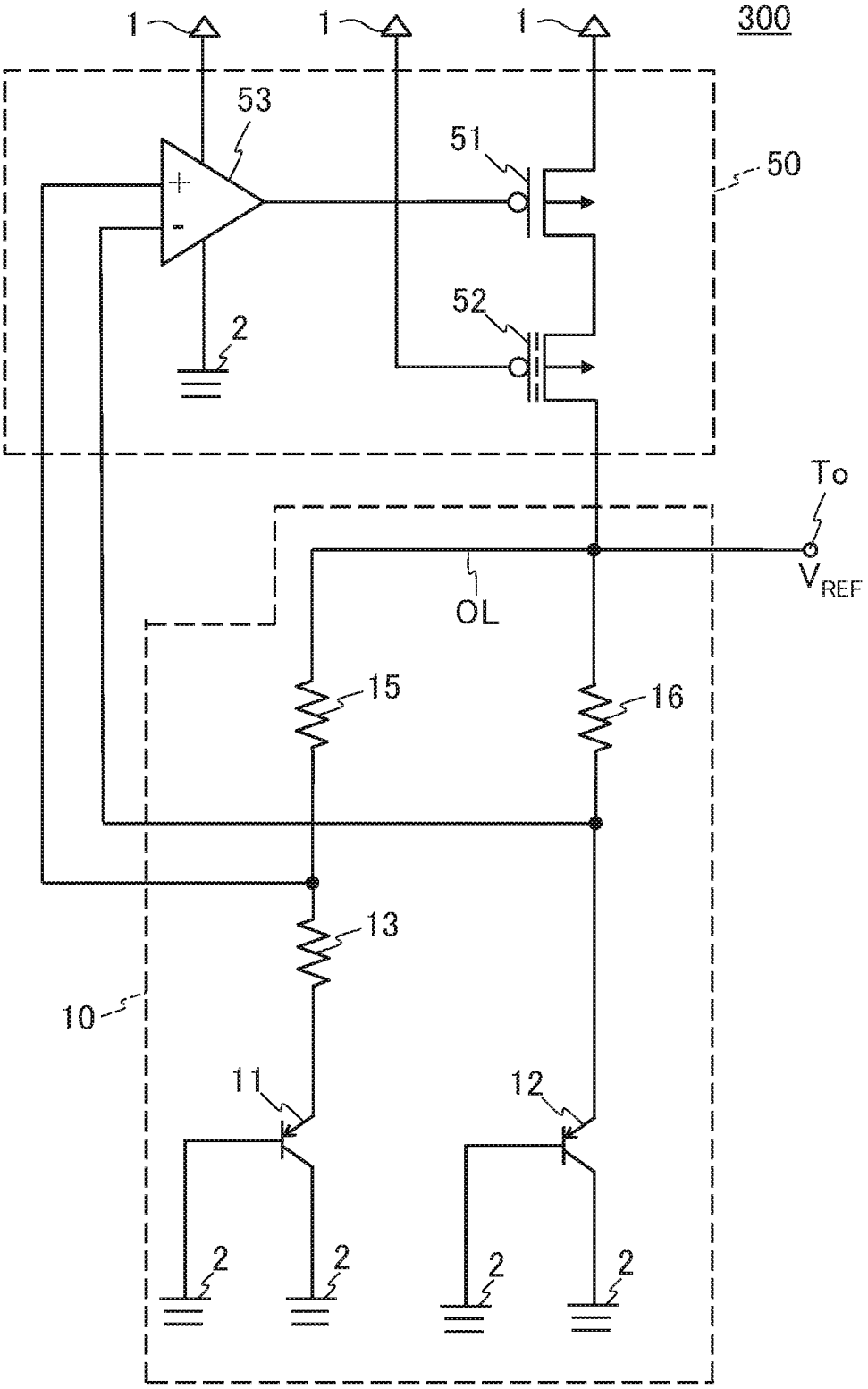
FIG. 3 is a circuit diagram for illustrating a third configuration example of the reference voltage circuit according to the embodiment.

FIG. 3 is a circuit diagram for illustrating a reference voltage circuit 300 serving as a third configuration example of the reference voltage circuit according to the embodiment.

The reference voltage circuit 300 is different from the reference voltage circuit 100 in that the reference voltage circuit 300 includes an output control circuit 50 instead of the output control circuit 30, but is not substantially different otherwise. Consequently, components that are not substantially different from those of the reference voltage circuit 100 are denoted by the same reference symbols, and description thereof is omitted.

The output control circuit 50 includes an enhancement PMOS transistor 51 serving as an output transistor, a depletion PMOS transistor 52 serving as a stabilization transistor, and an operational amplifier 53.

The enhancement PMOS transistor 51 contains a gate to be connected to an output port of the operational amplifier 53, a drain, and a source to be connected to the power supply terminal 1. The depletion PMOS transistor 52 contains a gate to be connected to the power supply terminal 1, a drain to be connected to the output line OL, and a source to be connected to the drain of the enhancement PMOS transistor 51.

The depletion PMOS transistor 52 is set so as to have such a constant that a gate-source voltage VGS_52 is equal to or more than a drain-source voltage VDS__51*s* in a saturation region of the enhancement PMOS transistor 51. In other words, the depletion PMOS transistor 52 is configured to satisfy the following expression (3):

$$VGS_52 \geq VDS_51s \quad (3).$$

The operational amplifier 53 is different from the operational amplifier 33 in that a connection destination of a non-inverting input port (+) and a connection destination of an inverting input port (−) are interchanged, but is the same as the operational amplifier 33 in that the operational amplifier 53 also includes a positive power supply port, a negative power supply port, the non-inverting input port (+), the inverting input port (−), and the output port.

In the operational amplifier 53, the non-inverting input port (+) is connected to a node between the first end of the resistor 13 and the second end of the resistor 15. Further, the inverting input port (−) is connected to a node between the emitter of the PNP bipolar transistor 12 and the second end of the resistor 16. The output port is connected to the gate of the enhancement PMOS transistor 51.

The reference voltage circuit 300 configured as described above acts similarly to the reference voltage circuit 100, and can provide a similar effect to that of the reference voltage circuit 100. That is, details of the action and the effect of the reference voltage circuit 300 can be described by reading, in the description of the action and the effect of the reference voltage circuit 100 described above, the output control circuit 30, the depletion NMOS transistor 31, and the depletion NMOS transistor 32 as the output control circuit 50, the enhancement PMOS transistor 51, and the depletion PMOS transistor 52, respectively.

The present invention is not limited to the above-described embodiments, and can be carried out in various forms in addition to the examples described above in the stage of carrying out the invention, and various omissions, replacements, and alterations may be made thereto without departing from the gist of the invention.

For example, in the reference voltage circuit 100, 200, 300 described above, description has been given of an example in which the PNP bipolar transistors 11 and 12 and the NPN bipolar transistor 21 are bipolar transistors, but the present invention is not limited thereto. At least one of the PNP bipolar transistors 11 and 12 and the NPN bipolar transistor 21 may be a diode.

For example, FIG. 1 shows the configuration example in which the source of the depletion NMOS transistor 31 serving as the output transistor and the gate of the depletion NMOS transistor 32 serving as the stabilization transistor are connected to each other (short-circuited) outside the output control circuit 30, but the present invention is not limited to the illustrated configuration example. The source of the output transistor and the gate of the stabilization transistor may be connected to each other inside the output control circuit.

To describe specifically, the source of the depletion NMOS transistor 31 and the gate of the depletion NMOS transistor 32 may be connected to each other inside the output control circuit 30. The source of the depletion NMOS transistor 41 and the gate of the depletion NMOS transistor 42 may be connected to each other inside the output control circuit 40. The source of the enhancement PMOS transistor 51 and the gate of the depletion PMOS transistor 52 may be connected to each other inside the output control circuit 50.

As an example of the reference voltage circuit according to the embodiment, description has been given of the reference voltage circuits 100 and 300 each including the reference voltage generation circuit 10 which is the BGR circuit, and of the reference voltage circuit 200 including the reference voltage generation circuit 20 which is the BGR circuit, but the reference voltage circuit according to the embodiment may include a reference voltage generation circuit other than a BGR circuit.

These embodiments and modifications thereof are encompassed in the scope and the gist of the invention, and are encompassed in the inventions defined in claims and equivalents thereof.

What is claimed is:

1. A reference voltage circuit including an output terminal, the reference voltage circuit comprising:

a reference voltage generation circuit which is configured to generate a reference voltage, and includes an output line for supplying the generated reference voltage to the output terminal; and an output control circuit which includes an output transistor and a stabilization transistor, and is configured to control the supply of the reference voltage to the output terminal, the output transistor containing a gate to which a control voltage is to be provided, a drain, and a source, the stabilization transistor containing a gate to be connected to the source of the output transistor, a drain, and a source to be connected to the drain of the output transistor, and being configured to have a gate-source voltage that is equal to or more than a drain-source voltage in a saturation region of the output transistor.

2. The reference voltage circuit according to claim 1, wherein the output transistor is a first depletion NMOS transistor containing a gate to which the control voltage is to be provided, a drain, and a source to be connected to the output line, and wherein the stabilization transistor is a second depletion NMOS transistor containing a gate to be connected to the source of the first depletion NMOS transistor, a drain to be connected to a first power supply terminal for supplying a first power supply voltage, and a source to be connected to the drain of the first depletion NMOS transistor.

3. The reference voltage circuit according to claim 2, wherein the reference voltage generation circuit includes:

a first resistor, a second resistor, and a third resistor each containing a first end and a second end;

a first diode containing an anode to be connected to the second end of the first resistor, and a cathode to be connected to a second power supply terminal for supplying a second power supply voltage; and a second diode containing an anode to be connected to the second end of the third resistor, and a cathode to be connected to the second power supply terminal, and wherein the output control circuit further includes an operational amplifier containing an inverting input port to be connected to the first end of the first resistor and the second end of the second resistor, a non-inverting input port to be connected to the anode of the second diode and the second end of the third resistor, and an output port to be connected to the gate of the first depletion NMOS transistor and supply the control voltage.

4. The reference voltage circuit according to claim 2, wherein the reference voltage generation circuit includes:

a diode and a first bipolar transistor which form a current mirror circuit;

a first resistor containing a first end to be connected to the output line, and a second end to be connected to an anode of the diode;

a second resistor containing a first end to be connected to the output line, and a second end to be connected to a collector of the first bipolar transistor; and a third resistor containing a first end to be connected to an emitter of the first bipolar transistor, and a second end to be connected to a second power supply terminal for supplying a second power supply voltage, and wherein the output control circuit further includes a second bipolar transistor containing a base to be connected to the second end of the second resistor and the collector of the first bipolar transistor, a collector to be connected to the first power supply terminal and the gate of the first depletion NMOS transistor, the first power supply terminal being connected via a constant current source, and an emitter to be connected to the second power supply terminal.

5. The reference voltage circuit according to claim 1, wherein the output transistor is an enhancement PMOS transistor containing a gate to which the control voltage is to be provided, a drain, and a source to be connected to a first power supply terminal for supplying a first power supply voltage, and wherein the stabilization transistor is a depletion PMOS transistor containing a gate to be connected to the source of the enhancement PMOS transistor, a drain to be connected to the output line, and a source to be connected to the drain of the enhancement PMOS transistor.

6. The reference voltage circuit according to claim 5, wherein the reference voltage generation circuit includes:

a first resistor, a second resistor, and a third resistor each containing a first end and a second end;

a first diode containing an anode to be connected to the second end of the first resistor, and a cathode to be connected to a second power supply terminal for supplying a second power supply voltage; and a second diode containing an anode to be connected to the second end of the third resistor, and a cathode to be connected to the second power supply terminal, and wherein the output control circuit further includes an operational amplifier containing an inverting input port to be connected to the anode of the second diode and the second end of the third resistor, a non-inverting input port to be connected to the first end of the first resistor and the second end of the second resistor, and an output port to be connected to the gate of the enhancement PMOS transistor and supply the control voltage.

* * * * *